US005638577A

United States Patent [19]

Gooding et al.

[11] Patent Number: 5,638,577

[45] Date of Patent: Jun. 17, 1997

[54] AUTOMOBILE JACK HANDLE

[75] Inventors: Harold William Gooding, Malinta; Mark Leonard Vajen, Deshler, both of Ohio

[73] Assignee: Claude Sintz, Inc., Deshler, Ohio

[21] Appl. No.: 695,719

[22] Filed: Aug. 12, 1996

[51] Int. Cl.[6] ..... A47B 95/02

[52] U.S. Cl. ..... 16/114 R; 16/DIG. 41; 74/557; 74/528; 81/177.85

[58] Field of Search ..... 16/114 R, DIG. 41; 74/557, 528, 543, 545; 81/124.6, 177.85; 403/329, 326, 321, 301

[56] References Cited

U.S. PATENT DOCUMENTS 2,434,282 3/1948 Mueller ..... 74/557

2,567,727 9/1951 Quackenbush ..... 403/326

4,791,826 12/1988 Behrens ..... 74/543

5,579,848 12/1996 Hsu ..... 403/301

*Primary Examiner*—Chuck Y. Mah

*Assistant Examiner*—Mark Williams

*Attorney, Agent, or Firm*—Thomas S. Baker, Jr.

[57] ABSTRACT

A multi-piece jack handle having selectively assembled and disassembled elongated rod sections is provided with a novel molded retainer sleeve having integral prong elements in one elongated rod section that are selectively engaged and disengaged from co-operation with an integral retention collar in another co-operating rod section.

4 Claims, 2 Drawing Sheets

AUTOMOBILE JACK HANDLE

CROSS-REFERENCES

None.

FIELD OF THE INVENTION

This invention relates generally to jacks for automobiles, and particularly concerns a multi-piece, torque-transmitting jack handle of the type that may be readily assembled for use following stowage in a compact space and that also may be readily disassembled for subsequent stowage following use.

BACKGROUND OF THE INVENTION

In modern automobiles space, whether it be within the passenger compartment or vehicle trunk, is often at a premium. In order to maximize the utilization of such space, it has become desirable in many instances to have a multi-piece jack handle that may be easily stored in an inconspicuous space and that can be both readily assembled for use and readily disassembled following use for subsequent out-of-the-way storage. Also, it is highly desirable to keep manufacturing costs of the desired jack handle to a minimum.

Multi-piece jack handles have been generally known since as early as the issuance of U.S. Pat. No. 1,286,161 issued in the name of Wagner for a folding jack handle invention and of the granting of U.S. Pat. No. 1,510,345 to Robertson. See also U.S. Pat. No. 1,169,496 issued to Knauff for an analogous folding street wrench.

Additional issued patents disclosing multi-piece handles but for use in other applications include U.S. Pat. No. 5,161,278 issued in the name of Tomm and U.S. Pat. No. 5,333,345 granted to O'Donnell. For another jack handle disclosure see also U.S. Pat. No. 5,301,389 granted to Engel et al.

We have discovered that such objectives can be achieved through the use of a novel construction for a multi-piece, automobile jack handle in those applications where the jack handle is utilized to primarily input torquing forces and moments to the jack.

SUMMARY OF THE INVENTION

The multi-piece jack handle of the present invention is basically comprised of two elongated rod sections that are typically fabricated of a low-carbon steel and selectively joined together prior to their use to actuate a co-operating conventional automobile jack assembly. One such elongated rod section is designated a hook rod and the other a drive rod section. The hook rod section has a conventional hook element at one end for engagement with the actuating mechanism of a co-operating conventional jack assembly, and has a fixed sleeve element integrally molded onto its other end. Such sleeve, which is preferably molded of a state-of-the-art nylon resin, includes integral socket and resilient retainer prong sub-elements.

The drive rod section is provided with a first drive end that co-operates with a standard drive wrench such as a ratchet wrench, a second drive end that co-operates with the integral socket molded into the hook rod element fixed sleeve, an integral upset retainer collar with which the resilient prongs of the sleeve element of the hook rod section selectively co-operate, and a slidable sleeve which may be selectively moved for jack handle disassembly purposes to release the engaged resilient prongs of the hook rod section molded integral sleeve from engagement with the drive rod section retainer collar element.

Other characteristics of the invention will become apparent from a consideration of the drawings and detailed description which follow.

DETAILED DESCRIPTION

Figure 1:
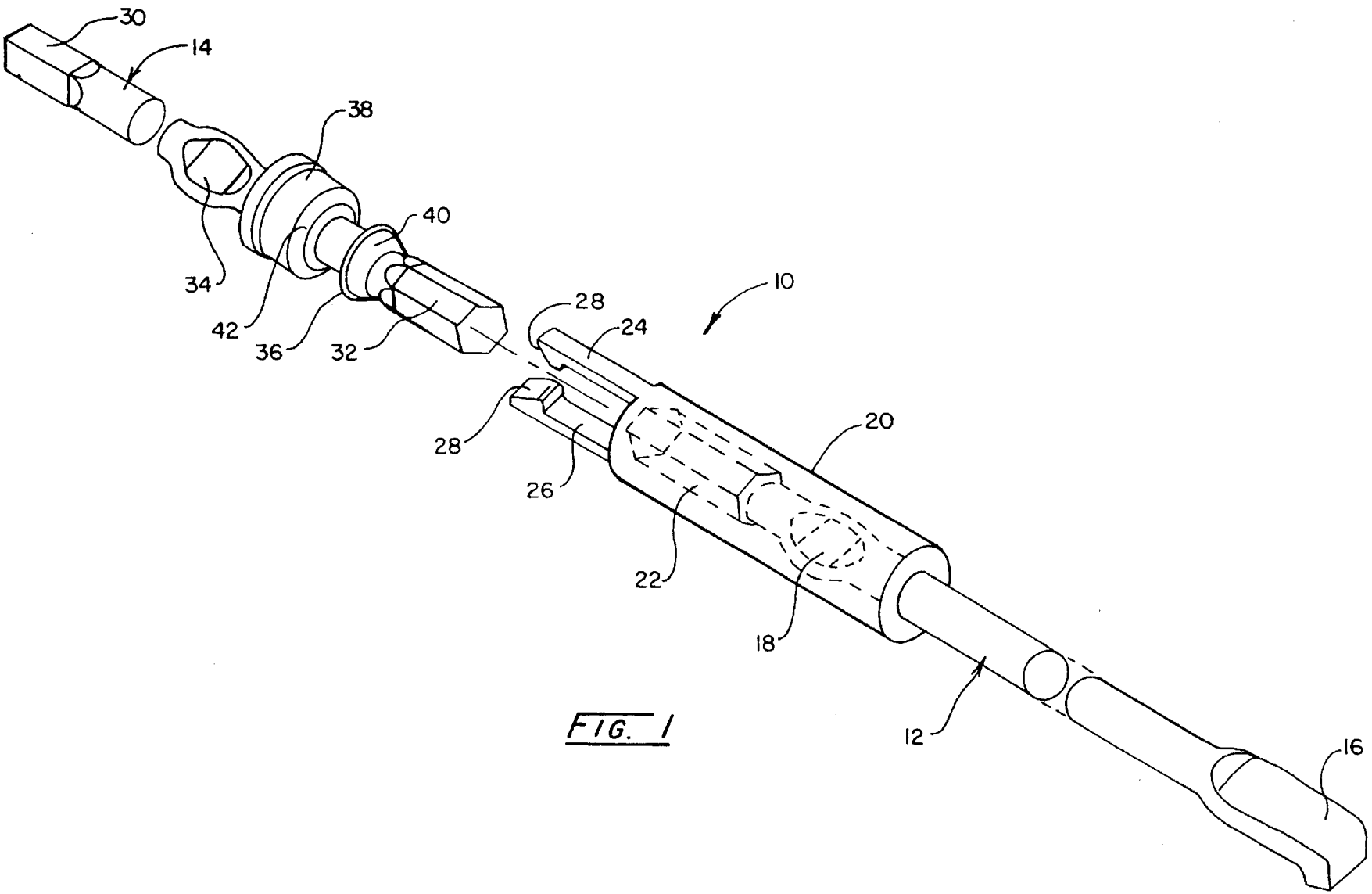
FIG. 1 is a schematic and exploded perspective view of a preferred embodiment of the jack handle of the present invention.

In FIG. 1 we illustrate a preferred embodiment of the jack handle 10 of the present invention, such jack handle basically being comprised of a hook rod section 12 and a drive rod section 14 that may be selectively joined to and disassembled from each other as hereinafter described. One end of hook rod section 12 is provided with an integral standard jack hook element 16 formed by upsetting. The other or coupling end of section 12 has a coined tab element 18 and also a fixed sleeve element 20 preferably molded of a conventional nylon resin integrally with rod section 12 and surrounding coined tab element 18. Tab element 18 precludes torquing moments being applied to sleeve element 20 by the co-operating end of joined rod section 14 from causing rotation of fixed sleeve element 20 relative to hook rod section 12. Also, fixed sleeve element 20 has an interiorly formed socket element 22, usually of hexagonal cross-sectional configuration, and paired, integrally-formed retainer prong elements 24 and 26. Each such retainer prong element is provided with a ramp surface 28 that functions as hereinafter described.

Handle rod section 14 has a first drive end 30 that normally co-operates with a wrench-type drive (not illustrated) which may take the form of a conventional ratchet wrench, and also has a second drive end 32 that is configured to co-operate with socket 22 provided in molded fixed sleeve element 20. Also, jack handle rod section 14 has coined tab feature 34, a retainer collar element 36 formed integrally in rod section 14 as by upsetting, and a slidable sleeve element 38 which may be fabricated of either a metal or of a molded nylon or other organic resin. Retainer collar element 36 has a ramp surface portion 40 that co-operates with the prong elements 24 and 26 of fixed sleeve element 20 when drive end 32 is inserted in socket 22 and functions to force prong element 24 and 26 apart as the two sections are engaged and until the prong elements resiliently snap over the left-most end of retainer collar element 36 to their position illustrated in FIG. 2. Ramp surfaces 28 engage ramp surfaces 40 at this stage of rod joinder.

Movable sleeve element 38 of rod section 14 is provided with a ramp surface portion 42. When it is desired to release rod section 14 from retained engagement with rod section 12 through the co-operation of prong element 24 and 26 with retainer collar 36, collar element 38 is advanced toward rod section 12 until ramp surface 42 contacts ramp surface portions 28 of prong element 24 and 26. Continued advancement of movable sleeve 38 causes prong elements 24 and 26 to be forced apart and out of engagement with rod section 14. Rod sections 12 and 14 may then be separated for subsequent storage.

Figure 2:
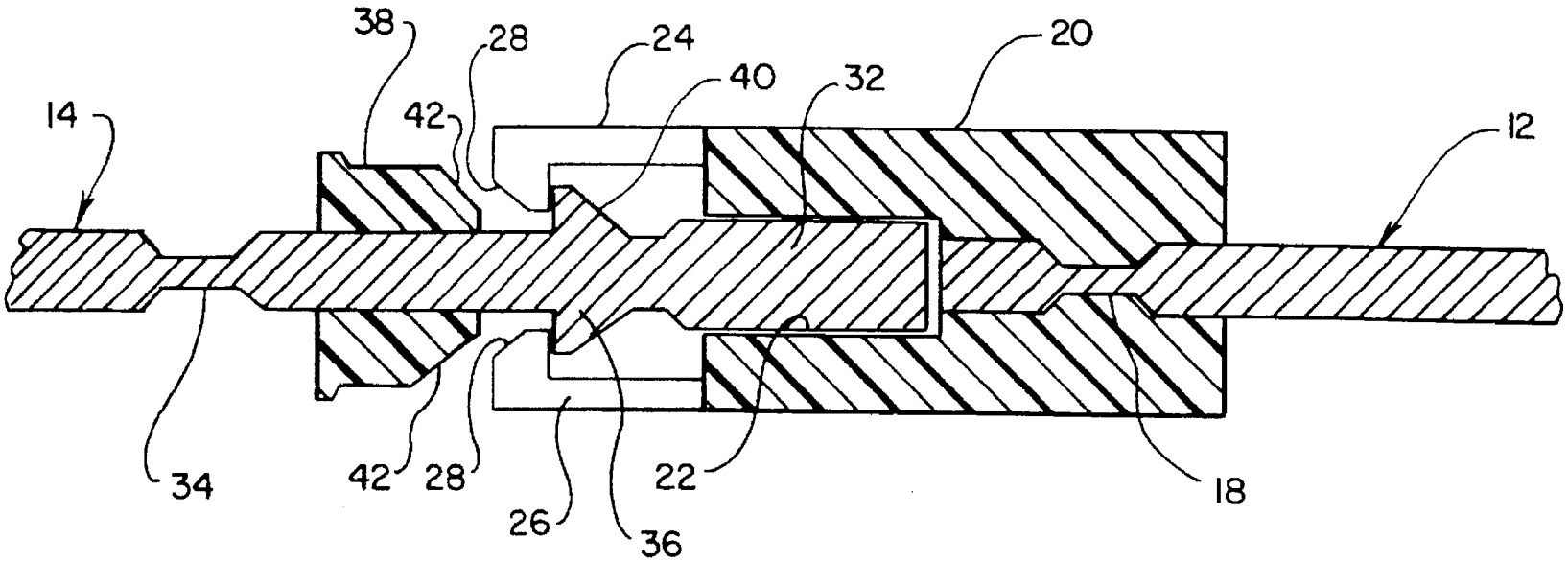
FIG. 2 is a sectional view of the co-operating end portions of the jack handle of FIG. 1 in their fully-engaged condition.

FIG. 2 illustrates the relationships that exist as between the different elements of jack handle 10 and their included features when the included hook and drive rod sections 12 and 14 are fully joined. In the joined condition, turning moments (torques) applied to drive end 30 of rod section 14 are fully and efficiently transmitted into hook rod section 12 through fixed sleeve element 20. Such has heretofore been accomplished at torque levels of up to 45 foot-pounds in at least one application of the jack handle.

Although the instant invention has been described in relation to a handle for an automobile jack, it should be apparent that the invention provides a mechanical disconnect device for use in any low speed torque transmission application.

Various changes may be made to the shapes, sizes, and materials of the different elements of the invention depending upon application requirements and may be accomplished without departing from the meaning or intent of the claims.

We claim our invention as follows:

1. A multi-piece jack handle comprising, in combination:

a first elongated rod section having a first drive end and an opposed second drive end;

a second elongated rod section having a hook end and an opposed coupling end that selectively cooperates with said first elongated rod section second drive end;

a retainer collar provided in said first elongated rod section in proximity to said first elongated rod section second drive end; and a retainer sleeve molded in joined relation to said second elongated rod section in proximity to said second elongated rod section opposed coupling end, said retainer sleeve having an integrally molded socket that is configured to be complementary to the configuration of said first elongated rod section second drive end, and having resilient, integrally molded prongs that selectively co-operate with said retainer collar when said first and second rod sections are fully joined.

2. The jack handle invention defined by claim 1 and further comprising a relatively movable release sleeve carried by said first elongated rod section at a position intermediate said first elongated rod section first drive end and said retainer collar, said release sleeve causing retention disengagement of said resilient prongs from said retainer collar when moved into forcible contact with said resilient prong.

3. The jack handle invention defined by claim 2 wherein said resilient prongs have ramp surface portions, wherein said release sleeve has a ramp surface portion, and wherein said resilient prongs ramp surface portions and said release sleeve ramp surface portion co-operate with each other to cause said retention disengagement.

4. The jack handle invention defined by claim 1 wherein said resilient prongs have ramp surface portions, wherein said retainer collar has a ramp surface portion, and wherein said resilient prong ramp surface portions and said retainer collar ramp surface portion co-operate with each other to cause retention engagement of said prongs with said retainer collar when said first and second rod sections are fully joined.

* * * * *